US011361721B2

(12) United States Patent
Wang

(10) Patent No.: US 11,361,721 B2
(45) Date of Patent: Jun. 14, 2022

(54) METHOD AND DEVICE FOR DRIVING DISPLAY PANEL, AND DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Mingliang Wang, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/042,779

(22) PCT Filed: Dec. 19, 2018

(86) PCT No.: PCT/CN2018/122186
§ 371 (c)(1),
(2) Date: Sep. 28, 2020

(87) PCT Pub. No.: WO2020/062629
PCT Pub. Date: Apr. 2, 2020

(65) Prior Publication Data

US 2021/0020129 A1 Jan. 21, 2021

(30) Foreign Application Priority Data

Sep. 26, 2018 (CN) ..... 201811134825.7

(51) Int. Cl.
*G09G 3/36* (2006.01)

(52) U.S. Cl.
CPC ... *G09G 3/3614* (2013.01); *G09G 2310/0243* (2013.01); *G09G 2310/08* (2013.01); *G09G 2370/00* (2013.01)

(58) Field of Classification Search
None
See application file for complete search history.

(56) References Cited

U.S. PATENT DOCUMENTS

2003/0128177 A1* 7/2003 Inoue ..... G09G 3/3614 345/87
2004/0239602 A1* 12/2004 Kim ..... G09G 3/3611 345/87

(Continued)

FOREIGN PATENT DOCUMENTS

CN 1694143 A 11/2005
CN 101572062 A 11/2009

(Continued)

OTHER PUBLICATIONS

First Office Action in counterpart Chinese Application No. 201811134825.7, dated Nov. 21, 2019.

(Continued)

*Primary Examiner* — Dorothy Harris
(74) *Attorney, Agent, or Firm* — Westbridge IP LLC

(57) ABSTRACT

Disclosed are a method and a device for driving a display panel, and a display device. The method includes: S200, detecting a frequency of a data output control signal TP1 when data is transmitted for the display panel, recording and storing the frequency as a first frequency F1; S300, judging whether the data output control signal TP1 works in a preset working time; S400, detecting a frequency of the data output control signal when the data output control signal TP1 works in the preset working time, recording and storing the frequency as a second frequency F2; and S600, calculating a frequency of a polarity control signal according to the first (Continued)

frequency F1 and the second frequency F2, and generating the polarity control signal according to the calculated frequency to drive the display panel.

9 Claims, 4 Drawing Sheets

(56) References Cited

U.S. PATENT DOCUMENTS

2005/0212744 A1* 9/2005 Hada ..... H04N 13/31 348/E13.059
2005/0248971 A1* 11/2005 Lee ..... G09G 5/006 365/63
2010/0171737 A1* 7/2010 Bae ..... G09G 3/3648 345/213
2010/0253611 A1* 10/2010 Takagi ..... G09G 3/36 345/98
2012/0001946 A1* 1/2012 Cho ..... G09G 3/3426 345/690
2014/0015819 A1 1/2014 Yamazaki et al.
2017/0025068 A1 1/2017 Jeoung et al.
2018/0053478 A1 2/2018 Xu

FOREIGN PATENT DOCUMENTS

CN 105551451 A 5/2016
CN 107615369 A 1/2018
KR 20070071496 A 7/2007

OTHER PUBLICATIONS

International Search Report and Written Opinion in corresponding PCT Application No. PCT/CN2018/122186, dated Jul. 2, 2019.

* cited by examiner

METHOD AND DEVICE FOR DRIVING DISPLAY PANEL, AND DISPLAY DEVICE

CROSS-REFERENCE TO RELATED APPLICATIONS

The present disclosure is the National Stage of International Application with No. PCT/CN2018/122186, filed Dec. 19, 2018, which claims the priority of Chinese Patent Application with No. 201811134825.7, entitled "DRIVING DEVICE, DISPLAY DEVICE AND DRIVING METHOD", filed on Sep. 26, 2018, which is hereby incorporated by reference in its entirety.

FIELD

The present disclosure relates to the technical field of liquid display panel driving, in particular to a method and device for driving display panel, and a display device.

BACKGROUND

The display panel normally includes a main control chip, a data drive chip, a row drive chip, and liquid crystal pixels. Control signals, polarity control signals, and data for displaying output by the main control chip are transmitted to the data drive chip, and then transmitted to the liquid crystal pixels by the data drive chip through data lines.

In order to eliminate the influence of residual direct current voltage in the liquid crystal pixels on displaying, the polarity of the data line may be reversed periodically. For example, in a previous frame, the polarity control signal is low level, and the data drive chip starts to output a negative voltage on the falling edge of the control signal for controlling data output; after the previous frame is finished, the polarity control signal is switched to high level; in a next frame, the data drive chip starts to output a positive voltage, thus realizing the control of the polarity through the polarity control signal. The polarity control signal there is transmitted from the main control chip to the data drive chip by a separate data line.

However, there are so many data signals and control signals for the communication interface of the current display panel, as such many lines are needed, resulting in increasing product defective rate and a size of Printed Circuit Board (PCB), and the cost is further increased accordingly.

SUMMARY

One main objective of the disclosure is to provide a method for driving a display panel, aiming to eliminate the data lines for transmitting polarity control signals and reduce production cost.

In order to achieve the above objective, the method for driving display panel provided by the present disclosure includes the following operations:

detecting a frequency of a data output control signal when data is transmitted for the display panel, recording and storing the frequency as a first frequency;

judging whether the data output control signal works in a preset working time;

detecting a frequency of the data output control signal when the data output control signal works in the preset working time, recording and storing the frequency as a second frequency; and calculating a frequency of a polarity control signal according to the first frequency and the second frequency, generating the polarity control signal according to the calculated frequency to drive the display panel.

In some embodiments, after the operation of "detecting a frequency of the data output control signal when the data output control signal works in the preset working time, recording and storing the frequency as a second frequency", the method further includes:

judging whether the second frequency is equal to zero in a first preset time duration.

In some embodiments, the operation of "calculating a frequency of a polarity control signal according to the first frequency and the second frequency", includes:

taking a frequency of a clock scan signal output by a row drive chip as the frequency of the polarity control signal when the second frequency is equal to zero in the first preset time duration.

In some embodiments, the operation of "calculating a frequency of a polarity control signal according to the first frequency and the second frequency", includes: taking the second frequency as the frequency of the polarity control signal when the second frequency is not equal to zero in the first preset time duration.

In some embodiments, the operation of "judging whether the data output control signal works in a preset working time", includes:

collecting the data output control signal and judging whether the data output control signal is low level;

judging whether the duration of the low level reaches a second preset time duration when the data output control signal is low level; and determining that the output control signal works in the preset working time when the duration of the low level reaches the second preset time duration.

In some embodiments, prior to the operation of "detecting a frequency of a data output control signal when data is transmitted for the display panel, recording and storing the frequency as a first frequency", the method further includes:

receiving an image data signal and extracting the data output control signal from the image data signal.

The present disclosure also provides a device for driving a display panel, which includes:

a first detecting module, configured to detect a frequency of a data output control signal when data is transmitted for the display panel, and record and store the frequency as a first frequency;

a first judging module, configured to judge whether the data output control signal works in a preset working time;

a second detecting module, configured to detect a frequency of the data output control signal when the data output control signal works in the preset working time, and record and store the frequency as a second frequency; and a driving module, configured to calculate a frequency of a polarity control signal according to the first frequency and the second frequency, and generate the polarity control signal according to the calculated frequency to drive the display panel.

In some embodiments, the device further includes: a second judging module, configured to judge whether the second frequency is equal to zero in the first preset time duration.

In some embodiments, the driving module is configured to take a frequency of a clock scan signal output by a row drive chip as the frequency of the polarity control signal when the second frequency is equal to zero in the first preset time duration. The driving module is also configured to take the second frequency as the frequency of the polarity control signal when the second frequency is not equal to zero within the first preset time duration.

The present disclosure also provides a display device, which includes:

a first detecting module, configured to detect a frequency of a data output control signal when data is transmitted for the display panel, and record and store the frequency as a first frequency; a first judging module, configured to judge whether the data output control signal works in a preset working time; a second judging module, configured to judge whether the second frequency is equal to zero in the first preset time duration; a second detecting module, configured to detect a frequency of the data output control signal when the data output control signal works in the preset working time, and record and store the frequency as a second frequency; and a driving module, configured to calculate a frequency of a polarity control signal according to the first frequency and the second frequency, and generate the polarity control signal according to the calculated frequency to drive the display panel. The driving module is configured to take a frequency of a clock scan signal output by a row drive chip as the frequency of the polarity control signal when the second frequency is equal to zero in the first preset time duration, and configured to take the second frequency as the polarity control signal when the second frequency is not equal to zero in the first preset time duration.

According to the technical solution of the present disclosure, the frequency of the data output control signal is detected during data transmission, and the frequency of the data output control signal in the preset working time is also detected, by which the frequency of the polarity control signal can be calculated and obtained, thereby generating the polarity control signal. According to the technical solution of the present disclosure, the polarity control signal can be directly calculated without arranging data lines for transmitting the polarity control signal between the main control chip and the data drive chip, thereby reducing the quantity of trace, improving the product yield, and reducing the cost.

BRIEF DESCRIPTION OF THE DRAWINGS

To clearly illustrate the technical solutions that are reflected in various embodiments according to this disclosure or that are found in the prior art, the accompanying drawings intended for the description of the embodiments herein or for the prior art will now be briefly described, it is evident that the accompanying drawings listed in the following description show merely some embodiments according to this disclosure, and that those having ordinary skill in the art will be able to obtain other drawings based on the arrangements shown in these drawings without making inventive efforts.

The realizing of the aim, functional characteristics, advantages of the present disclosure are further described in detail with reference to the accompanying drawings and the embodiments.

DETAILED DESCRIPTION OF EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present invention without creative efforts shall fall within the protection scope of the present invention.

It is to be understood that, all of the directional instructions in the exemplary embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides a method for driving a display panel. In the exemplary embodiment, the method is applied to a display device, such as a liquid crystal device.

Figure 1:
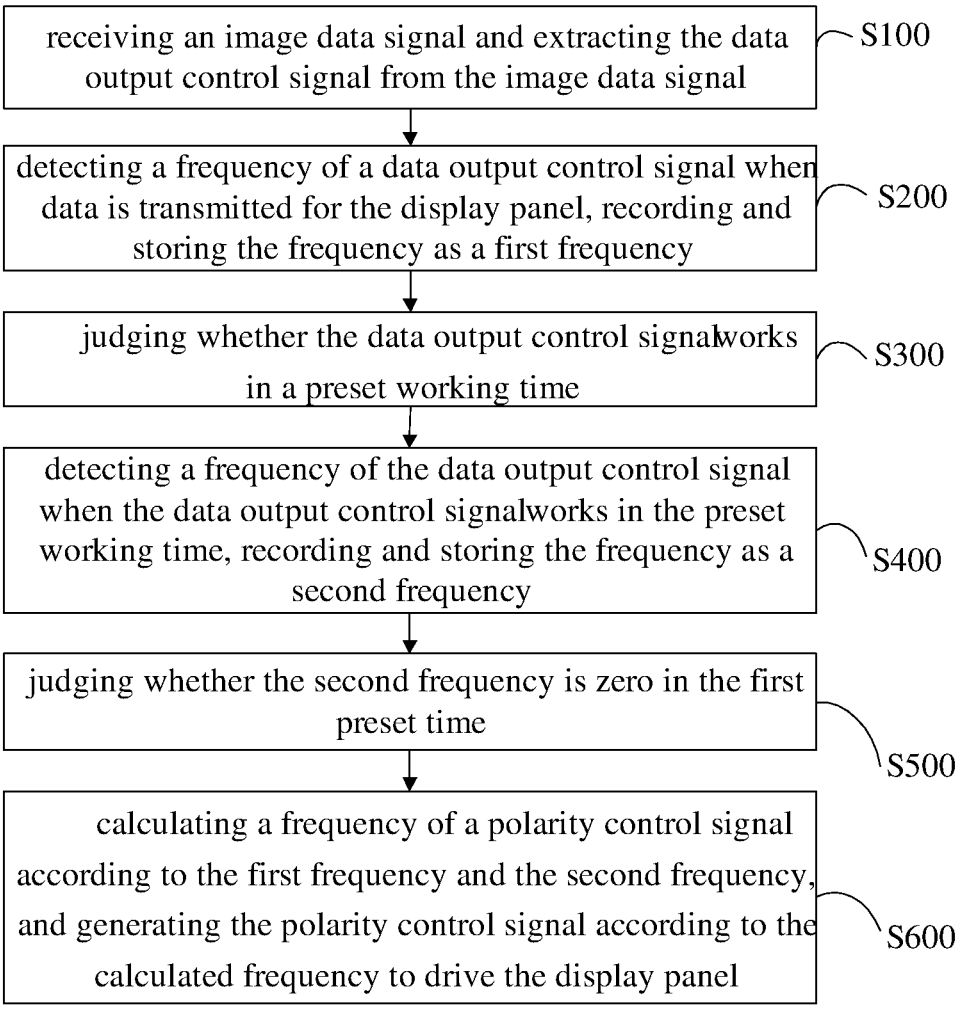
FIG. 1 is a flowchart of a method for driving a display panel according to an exemplary embodiment of the present disclosure.

In the exemplary embodiment of the present disclosure, the method for driving display panel as shown in FIG. 1 includes the following steps:

S200, detecting a frequency of a data output control signal when data is transmitted for the display panel, recording and storing the frequency as a first frequency;

S300, judging whether the data output control signal works in a preset working time;

S400, detecting a frequency of the data output control signal when the data output control signal works in the preset working time, recording and storing the frequency as a second frequency; and S600, calculating a frequency of a polarity control signal according to the first frequency and the second frequency, and generating the polarity control signal according to the calculated frequency to drive the display panel.

Figure 2:
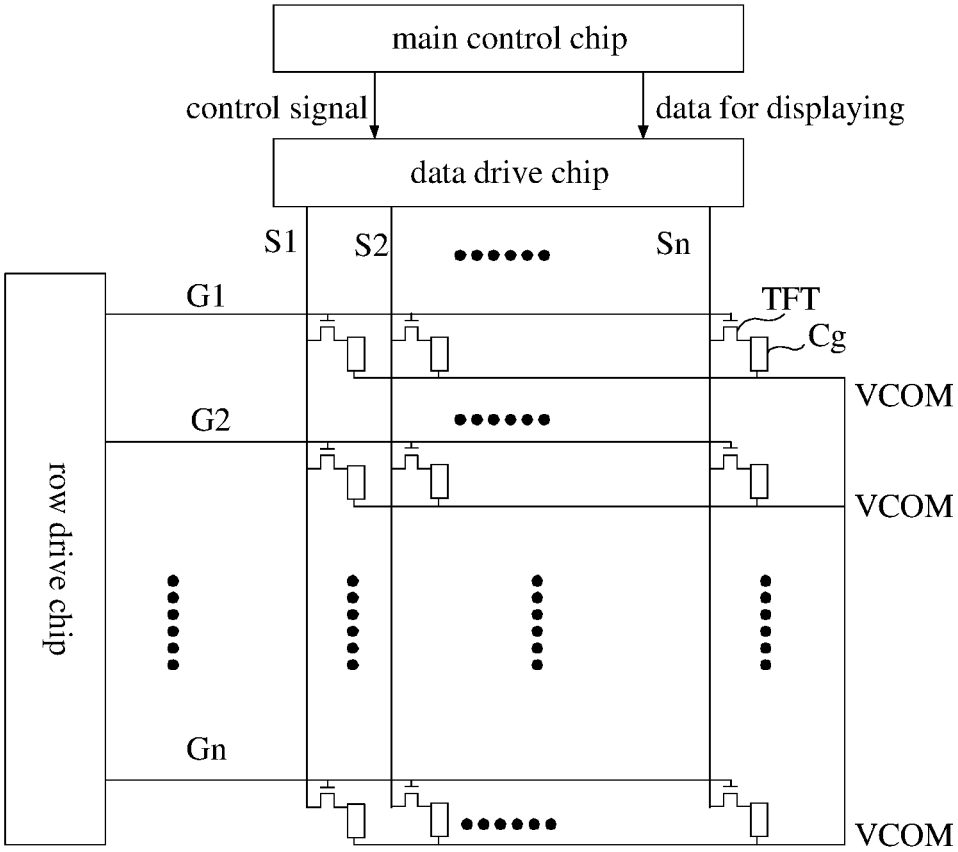
FIG. 2 is a structural diagram of a device for driving a display panel according to an exemplary embodiment of the present disclosure.

Referring to FIG. 2, the liquid crystal panel normally includes a main control chip, a data drive chip, a row drive chip, a thin film transistor, and liquid crystal pixels. The liquid crystal panel also includes a plurality of scan lines (i.e., S1 to Sn) and data lines (i.e., G1 to Gn). The scan lines and data lines are crisscrossed to form a plurality of cells, and each of the cells is provided with a liquid crystal capacitor Cg and a thin film transistor (TFT). The scan line is connected to the row drive chip and a controlled end of the corresponding thin film transistor, and the scan line outputs a clock scan signal for controlling the switching of the thin film transistor. The data line is connected to the data drive chip and an input end of the corresponding thin film transistor. The output end of the thin film transistor is connected to a corresponding liquid crystal capacitor Cg.

Figure 3:
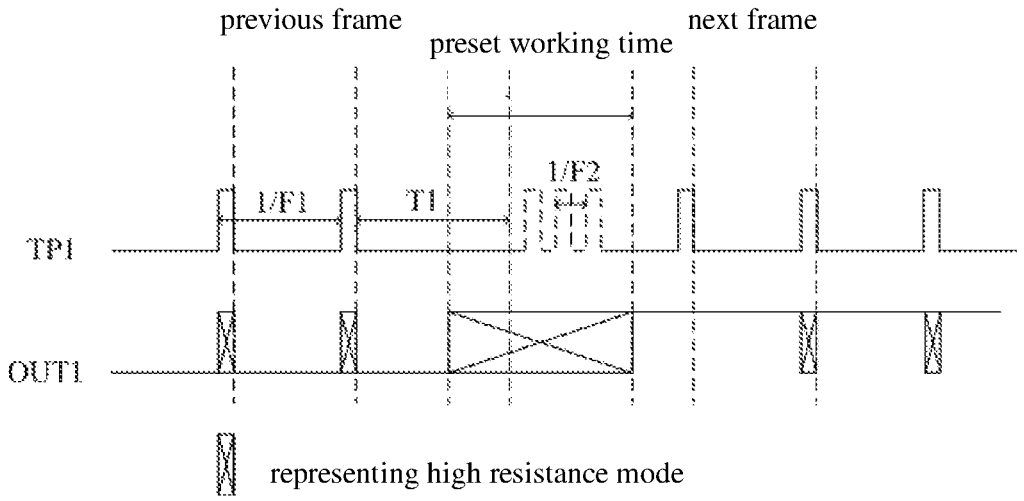
FIG. 3 is a signal timing diagram of the method for driving display panel according to an exemplary embodiment of the present disclosure.

Referring to FIG. 3, it should be noted that the data output control signal TP1 and the polarity control signal are two necessary control signals for the data drive chip. The data output control signal TP1 is configured for latching data and controlling the magnitude of the output voltage, and the polarity control signal is configured for controlling the polarity of the output voltage. In FIG. 3, OUT1 is regarded as the data output signal of the data drive chip. After finishing output of a previous frame and before an output of a next frame, the data drive chip would work in a high resistance mode, which means that the data drive chip stops outputting during this period.

The polarity control signal is a level signal which includes a low level state and a high level state. As the low level voltage and high level voltage are well known, the polarity control signal can be obtained as long as the frequency of the polarity control signal is determined.

In the exemplary embodiment, the frequency of the polarity control signal is calculated according to the first frequency and the second frequency, followed by generating the polarity control signal to drive the panel.

In step S300, the preset working time (V-blank) refers to a time period during which no data is transmitted to the data drive chip.

According to the technical solution of the present disclosure, the frequency of the data output control signal TP1 is detected during data transmission, and the frequency of the data output control signal TP1 in a preset working time is also detected, by which the frequency of the polarity control signal is obtained, thereby generating the polarity control signal. According to the technical solution of the present disclosure, the polarity control signal can be directly calculated without arranging data lines for transmitting the polarity control signal between the main control chip and the data drive chip, thereby reducing the quantity of trace, improving the product yield, and reducing the cost.

In some exemplary embodiments, after the operation of "detecting a frequency of the data output control signal TP1 when the data output control signal TP1 works in the preset working time, recording and storing the frequency as a second frequency", the method further includes:

S500, judging whether the second frequency is equal to zero in the first preset time duration.

It should be noted that, in case the level of the data output control signal TP1 is continuously high level or low level when the data output control signal TP1 works in the preset working time, then the second frequency is determined to be equal to zero.

In some exemplary embodiments, the operation of calculating the frequency of the polarity control signal according to the first frequency and the second frequency, includes:

taking a frequency of a clock scan signal output by a row drive chip as the frequency of the polarity control signal when the second frequency is equal to zero in the first preset time duration.

It should be noted that, when the second frequency is equal to zero, it is determined that the display panel is leaved in a column inversion mode, and the frequency of the polarity control signal is the same as the frequency of the clock scan signal.

In some exemplary embodiments, the operation of calculating the frequency of the polarity control signal according to the first frequency and the second frequency, includes:

taking the second frequency as the frequency of the polarity control signal when the second frequency is not equal to zero within the first preset time duration.

The frequency of the polarity control signal is the same as the second frequency when it is detected that the second frequency is not equal to zero.

In some exemplary embodiments, the operation of "judging whether the data output control signal TP1 works in a preset working time", includes:

collecting the data output control signal TP1 and judging whether the data output control signal TP1 is low level;

judging whether the duration of the low level reaches a second preset time duration when the data output control signal is low level; and determining that the output control signal works in the preset working time when the duration of the low level reaches the second preset time duration. In the exemplary embodiment, the present working time is an idle time of the liquid crystal display.

Please continue to refer to FIG. 3, there is no data transmission during a switching interval between the previous frame and the next frame, and the switching interval is also called idle time. When the liquid crystal display panel is in the idle time, the data output control signal TP1 is always low level, so whether or not the liquid crystal display panel works in the idle time may be determined by judging the duration of the data output control signal TP1 in low level.

In some embodiments, prior to the operation of "detecting a frequency of a data output control signal TP1 when data is transmitted for the display panel, recording and storing the frequency as the first frequency", the method further includes:

S100, receiving an image data signal and extracting the data output control signal from the image data signal.

It is easy to understand that the main control chip receives the image data signal sent from the liquid crystal panel logic board (such as a timing controller (TCON)) and extracts the data output control signal TP1 from the image data signal.

Figure 4:
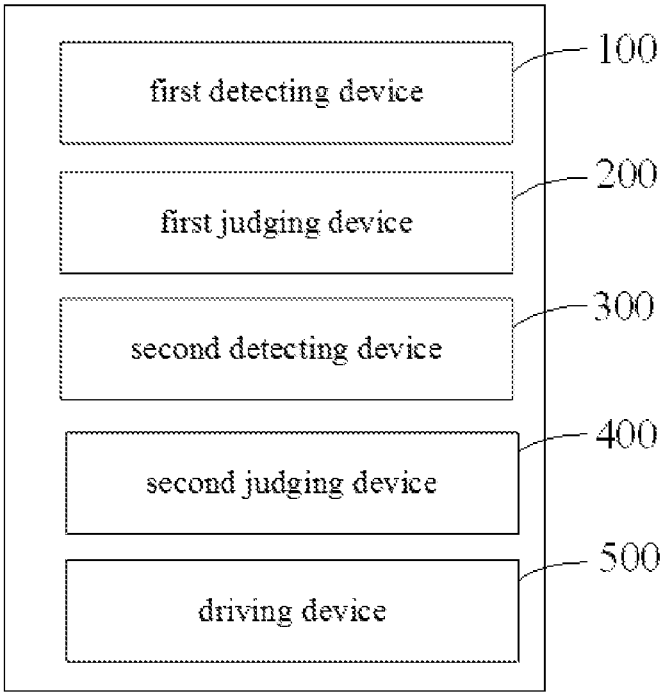
FIG. 4 is a functional block diagram of the device for driving display panel according to an exemplary embodiment of the present disclosure.

Referring to FIG. 4, the present disclosure also provides a device for driving a display panel, which includes:

a first detecting module 100, configured to detect a frequency of a data output control signal TP1 when data is transmitted for the display panel, and record and store the frequency as a first frequency;

a first judging module 200, configured to judge whether the data output control signal TP1 works in a preset working time;

a second detecting module 300, configured to detect a frequency of the data output control signal TP1 when the data output control signal TP1 works in the preset working time, and record and store the frequency as a second frequency; and a driving module 500, configured to calculate a frequency of a polarity control signal according to the first frequency and the second frequency, and generate the polarity control signal according to the calculated frequency to drive the display panel.

During normal data transmission, the frequency of the data output control signal TP1 is detected and recorded as F1. When working in the preset working time (V-blank), the data output control signal TP1 is always low level, at this time, it is started to detect the time at which the data output control signal TP1 is low level.

When it is detected that the time duration exceeds a set value T1, it is considered that the data output control signal TP1 works in the V-blank time, and followed the frequency of the data output control signal TP1 is detected.

If a detected frequency F2 of the data output control signal TP1 is integral multiple of the previously recorded frequency F1, then the frequency F2 is taken as a frequency of the signal switching of the polarity control signal. if the detected data output control signal TP1 is always high level or low level, namely the frequency F2 is equal to zero, which indicates a column inversion mode, and the polarity control signal is switched once per frame.

In this way, the polarity control signal is obtained, and then the data drive chip is controlled to output corresponding polarity, thus achieving the purpose of the present disclosure.

In some exemplary embodiments, the driving device of the display panel further includes:

a second judging module 400, configured to judge whether the second frequency is equal to zero in the first preset time duration.

The driving module 500 is configured to take a frequency of a clock scan signal output by a row drive chip as the frequency of the polarity control signal when the second frequency is equal to zero in the first preset time duration, and configured to take the second frequency as the frequency of the polarity control signal when the second frequency is not equal to zero within the first preset time duration.

Based on the aforementioned device for driving display panel, the present disclosure also provides a display device, which includes the aforementioned device for driving display panel. The specific structure of the device for driving the display panel can be referred to the above-mentioned exemplary embodiments. Since the display device adopts all the technical solutions of the above exemplary embodiments, the display device at least has all of the beneficial effects of the technical solutions of the above exemplary embodiments, and no need to repeat again.

Referring to FIG. 2, the liquid crystal panel normally includes a main control chip, a data drive chip, a row drive chip, a thin film transistor, and liquid crystal pixels. The liquid crystal panel also includes a plurality of scan lines (i.e., S1 to Sn) and data lines (i.e., G1 to Gn). The scan lines and data lines are crisscrossed to form a plurality of cells, and each of the cells is provided with a liquid crystal capacitor Cg and a Thin Film Transistor (TFT). The scan line is connected to the row drive chip and a controlled end of the corresponding thin film transistor, and the scan line outputs a clock scan signal for controlling the switching of the thin film transistor. The data line is connected to the data drive chip and an input end of the corresponding thin film transistor. The output end of the thin film transistor is connected to a corresponding liquid crystal capacitor Cg.

Figure 5:
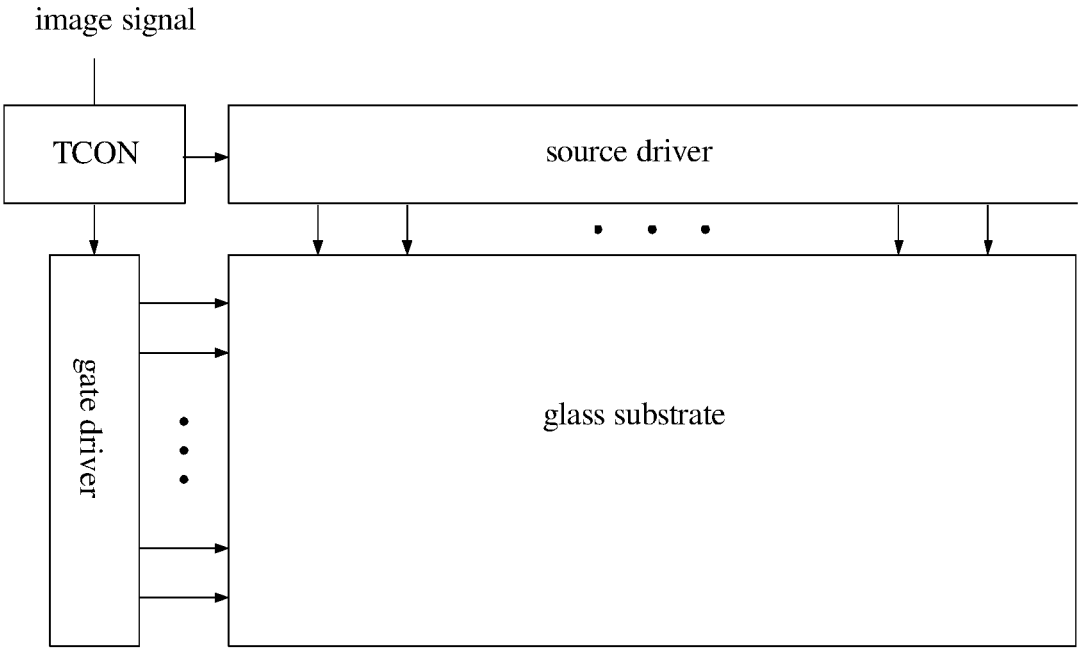
FIG. 5 is a functional block diagram of a display device according to an exemplary embodiment of the present disclosure.

Referring to FIG. 5, the display device further includes a logic board, and the logic board (i.e., TCON) is electrically connected to the driving device. The driving device is provided with a gate driver and a source driver, and the gate driver and the source driver are both connected with the logic board.

It should be noted that a plurality of pixels arranged in a matrix are arranged on the glass substrate. Each of the pixels includes three primary color sub-pixels, namely RGB sub-pixels representing red, green and blue. The image data is inputted to TCON, then the image data is processed and transformed to form the display data signal, and clock control signals of the source driver and the gate driver. Specifically, the data signal is loaded by the source driver, the timing is controlled by the gate driver, and the clock signal is transmitted to the pixels of the glass substrate by the drive plate, thus realizing the scan display of the images.

The foregoing descriptions are merely specific implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A method for driving a display panel, comprising:

receiving, by a main control of the display panel, an image data signal from a timing controller, and extracting a data output control signal from the image data signal, and detecting a frequency of a data output control signal as a first frequency when data is transmitted for the display panel;

when detecting that a duration time of the data output control signal in a low level exceeds a set value, determining that it is in an idle time of the display panel, wherein the data is not transmitted in the idle time of the display panel;

continuing to detecting a frequency of the data output control signal as a second frequency in the idle time of the display panel;

determining a frequency of a polarity control signal according to the first frequency and the second frequency, and generating the polarity control signal according to the determined frequency of the polarity control signal to drive the display panel.

2. The method according to claim 1, further comprising:

the data output control signal being in column inversion and taking a frequency of a clock scan signal output by a row drive chip as the frequency of the polarity control signal when the second frequency is equal to zero in the idle time.

3. The method according to claim 1, further comprising:

taking the second frequency as the frequency of the polarity control signal when the second frequency is not equal to zero and is integral multiple of the first frequency previously recorded within the idle time.

4. A device for driving display panel, wherein the device comprises:

a first detecting device, configured to receive, by a main control of the display panel, an image data signal from a Timing Controller, and extract a data output control signal from the image data signal, and detect a frequency of a data output control signal as a first frequency when data is transmitted for the display panel;

a determining device, configured to determine that it is in an idle time of the display panel when detecting that a duration time of the data output control signal in a low level exceeds a set value, wherein the data is not transmitted in the idle time of the display panel;

a second detecting device, configured to continue to detect a frequency of the data output control signal as a second frequency in the idle time of the display panel; and a driving device, configured to determine a frequency of a polarity control signal according to the first frequency and the second frequency, and generate the polarity control signal according to the determined frequency of the polarity control signal to drive the display panel.

5. The device according to claim 4, wherein the driving device is configured to take a frequency of a clock scan signal output by a row drive chip row drive chip as the frequency of the polarity control signal when the second frequency is equal to zero in the idle time.

6. The device according to claim 4, wherein the second frequency is taken as the frequency of the polarity control signal when the second frequency is not equal to zero and is integral multiple of the first frequency previously recorded within the idle time.

7. A display device, wherein the display device comprises:

a first detecting device, configured to receive, under a main control of the display panel, an image data signal from a timing controller, and extract a data output control signal from the image data signal, and detect a frequency of a data output control signal as a first frequency when data is transmitted for the display panel;

a determining device, configured to determine that it is in an idle time of the display panel when detecting that a duration time of the data output control signal in low level exceeds a set value, wherein the data is not transmitted in the idle time of the display panel;

a second detecting device, configured to continue to detect a frequency of the data output control signal as a second frequency in the idle time of the display panel; and a driving device, configured to determine a frequency of a polarity control signal according to the first frequency and the second frequency, and generate the polarity control signal according to the determined frequency of the polarity control signal to drive the display panel.

8. The display device according to claim 7, wherein the driving device is configured to take a frequency of a clock scan signal output by a row drive chip as the frequency of the polarity control signal when the second frequency is equal to zero in the idle time.

9. The display device according to claim 7, wherein the second frequency is taken as the frequency of the polarity control signal when the second frequency is not equal to zero and is integral multiple of the first frequency previously recorded within the idle time.

* * * * *